US005509529A

United States Patent [19]

Kelley

[11] Patent Number: 5,509,529

[45] Date of Patent: Apr. 23, 1996

[54] SOAP BAR HOLDER

[76] Inventor: Kenneth H. Kelley, 4155 U.S. 41, North, Byron, Ga. 31008

[21] Appl. No.: 390,405

[22] Filed: Feb. 16, 1995

[51] Int. Cl.[6] ..... A47K 5/00

[52] U.S. Cl. ..... 206/77.1; D6/540; 4/628; 220/260; 220/335; 220/343

[58] Field of Search ..... D6/525, 536, 540; 4/559, 596, 605, 628; 206/77.1; 211/88, 90; 220/260, 264, 335, 338, 343; 248/223.4, 225.1, 225.2; 312/242

[56] References Cited

U.S. PATENT DOCUMENTS

| | | | |
|---|---|---|---|
| 192,997 | 7/1877 | Hopfen . | |
| 962,091 | 6/1910 | Pagan . | |
| 1,211,353 | 1/1917 | Rautzenburg | 206/77.1 |
| 1,305,918 | 6/1919 | May . | |
| 1,709,182 | 4/1929 | McKnight et al. . | |
| 2,175,673 | 10/1939 | Shields | 220/343 |
| 2,194,067 | 7/1939 | Campbell . | |
| 2,465,752 | 3/1949 | Rodbell . | |
| 2,596,675 | 5/1952 | Giossi | 206/77.1 |
| 2,879,622 | 3/1959 | Graziano | 206/77.1 |
| 3,166,080 | 1/1965 | Neale | 206/335 |
| 4,435,030 | 3/1984 | Haven . | |
| 4,630,794 | 12/1986 | Ross . | |
| 4,709,428 | 12/1987 | Garcia | 206/77.1 |
| 4,799,604 | 1/1989 | Okojima et al. | 220/335 |

*Primary Examiner*—Jimmy G. Foster
*Attorney, Agent, or Firm*—James A. Hinkle

[57] ABSTRACT

A soap bar holder that is suitable for use in a shower stall, tub or by a sink is disclosed. The soap bar holder comprises an enclosure (11) with an opening (24) sized to accommodate a bar of soap (48) defined by two side walls (12,16) and a back wall (19). A lid (25) pivotally attaches to the enclosure and covers the opening with a gasketed, water tight seal when the soap is not in use. The lid is spring (31) loaded to provide for easy access to the soap by pressing a release button (35). Also, the enclosure slidably and removably engages with a mounting plate (36) for easy access to the enclosure for cleaning.

8 Claims, 2 Drawing Sheets

SOAP BAR HOLDER

BACKGROUND OF THE INVENTION

1. Field of the Invention

The present invention relates to a soap bar holding and dispensing device.

2. Description of the Related Art

It is a well known fact that the useful life of a bar of soap is adversely affected by exposure to streams or puddles of water. Water that impacts the surface of the bar of soap or builds up underneath the bar of soap accelerates the dissolution of the soap. In order to address the problem, there have been many attempts to create shelves or soap boxes to eliminate the waste created by unnecessary exposure of the bar of soap to water. It is quite common for shower stalls to have a recessed shelf with a ribbed surface. The recessed shelf takes the bar of soap out of the line of direct impact with water from the shower, and the ribbed surface prevents the bar of soap from sitting in a pool of water which causes an acceleration of the decay of the soap bar. These recessed and ribbed surfaces prevent a lot of the decay associated with unnecessary contacts of the soap with water. However, water can still impact the bar of soap after being reflected from other surfaces in the shower stall or from the person using the shower stall. Also, the ribbed surface inevitably accumulates soap residue which must be cleared away by scrubbing.

U.S. Pat. No. 4,435,030 describes a wall mounted holder in which the soap may be slipped into the dispenser from the bottom thereof, and maintained in position by a pivotal support member which swings on a pivot point 35 and catches and holds the soap bar when placed therein with the foot 36. The soap bar can be automatically dispensed by pushing lever 40.

U.S. Pat. No. 4,630,794 describes a wall mounted soap dispenser in which the soap bar is loaded from the top into a pivoting enclosure. The pivoting enclosure positions the soap on a holding shelf and shelters the soap. In order to dispense the soap, the user pushes the pivoting enclosure which pivots and allows the soap to pass through an exit opening.

SUMMARY OF THE INVENTION

The present invention addresses the problem of the dissolution of soap bars due to contact with water streams and puddles of water when the soap bar is not in use. The present invention comprises an enclosure having two side walls and a back wall which define an opening sized to accommodate a bar of soap. The enclosure has a pivotally attached lid which is made to pivot by means of a pin. The lid has a hook which engages with a latch on the base of the enclosure. The hook and latch can be disengaged by a release button which retracts the latch from the hook. The lid has a coil spring which provides an opening force when the release button is pressed.

The base has perforations for draining the excess water back into the tub or shower, and ridges for the soap to sit on.

The lid is pivotally attached to the enclosure by the pin which extends through tabs extending downward from the inner surface of the lid, and openings in the side walls which hold the ends of the pin. The openings in the side walls have an entry portion which allows the ends of the pin to be snapped down into the openings in the side walls. The lid rests on recessed portions of the side wall which have a depth approximately equal to the thickness of the lid plus any gasket material.

The enclosure is removably mounted on a mounting plate which attaches to the wall in the shower or tub area. The back wall of the enclosure has a T-shaped slot which removably and slidably engages with the mounting plate. The required profile for engaging with the T-shaped slot is formed by removing a portion of the width of the sides of the mounting plate along a portion of the length of the sides. By removing a portion of the width of the sides, there is formed a projection on each side of the mounting plate which extends along a portion of the side of the plate. The projection does not extend the entire length of the side because the full side width at the bottom of the side of the mounting plate acts as a stop so that the enclosure does not slide off of the mounting plate.

DESCRIPTION OF THE PREFERRED EMBODIMENTS

Figure 1:
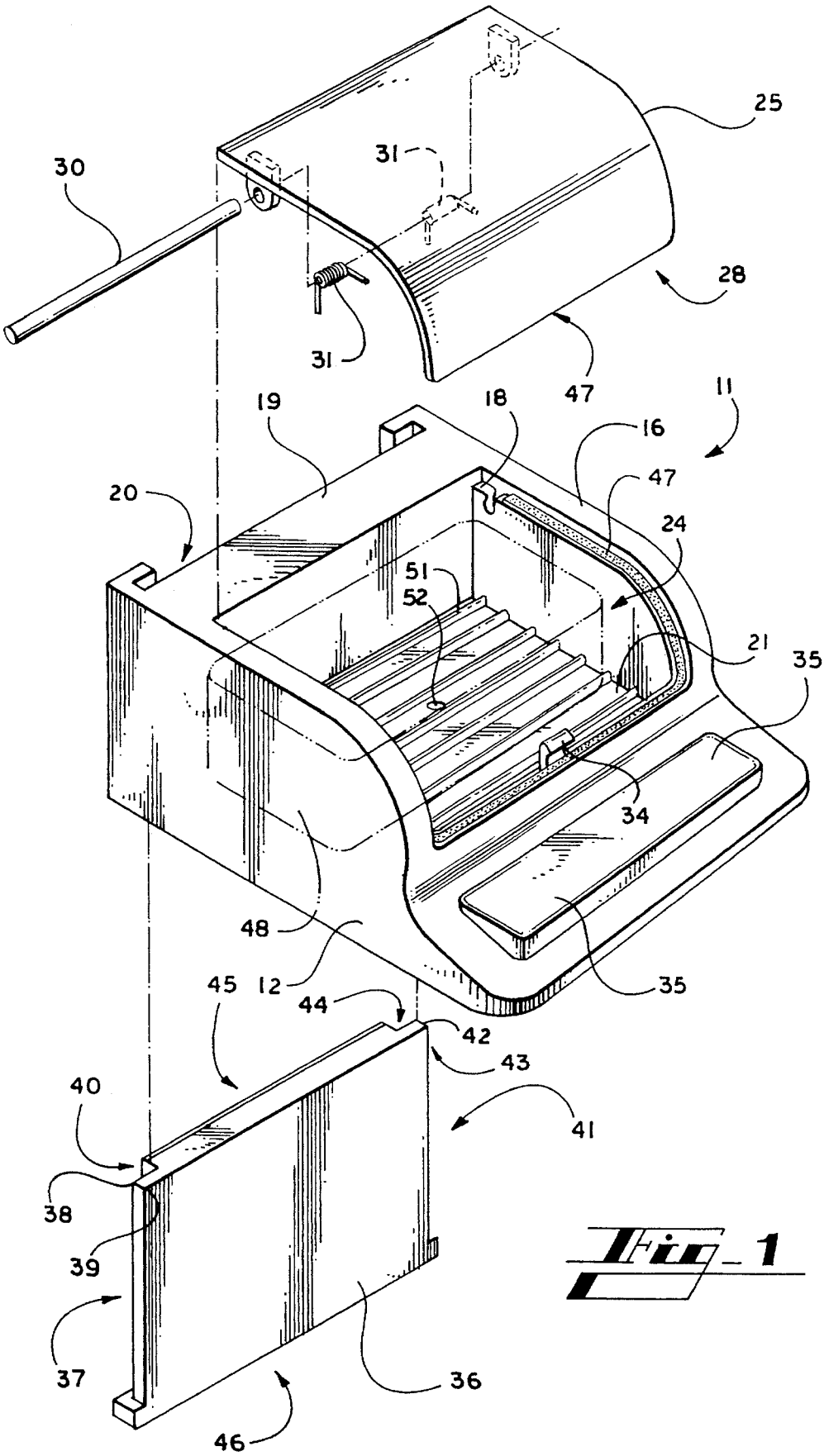
FIG. 1 is a perspective view of the elements of the present invention.
Figure 2:
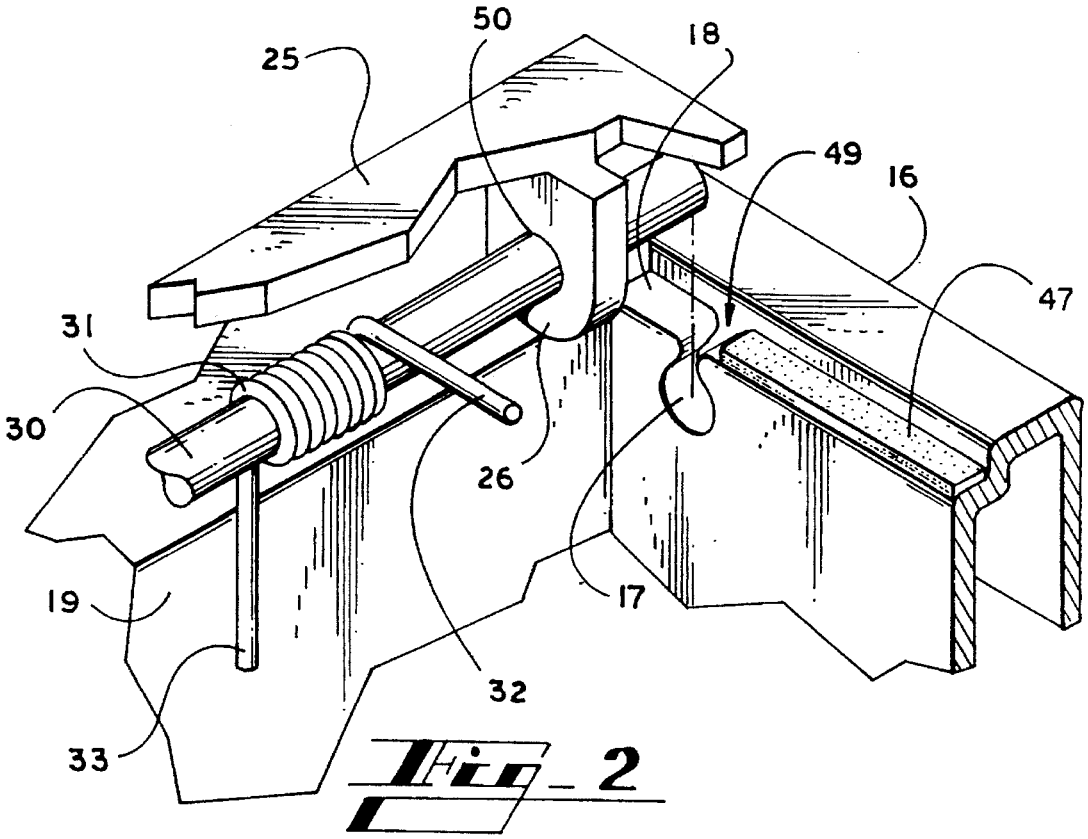
FIG. 2 is a broken away perspective view of the pin and hinge mechanism of the present invention.

Referring to the drawings wherein like reference numerals designate corresponding parts throughout the several figures, and especially referring to FIG. 1 showing a perspective view of the present invention, the invention comprises an enclosure 11 which can be mounted on a vertical wall such as the wall next to a shower or tub or can be mounted on a horizontal surface near a sink. The first side wall 12, the second side wall 16 and the back wall 19 define the opening 24 in the enclosure. The opening 24 is sized to accommodate a standard bar of soap 48. In order for the lid 25 to pivotally attach to the enclosure, the first side wall 12 has an opening 13 (not shown) which receives one end of a pin 30. The first side wall 12 is preferably made with an entry portion 14 (not shown) which allows the pin 30 to be snapped down into place in the opening 13. The first side wall 12 also has a recessed edge 15 (not shown) which is recessed to a depth equal to the approximate width of the lid 25 plus the gasket 47. The lid will rest on the recessed edge 15. The second side wall 16 has an opening 17 which receives the other end of the pin 30. The second side wall 16 also has an entry portion 49 which allows the pin 30 to be snapped down into place in the opening 17. Also, the second side wall 16 has a recessed edge 18 which is recessed to a depth equal to approximately the width of the lid 25 plus the width of the gasket 47.

In the situation where the soap bar holder is to be mounted on a vertical surface such as the wall of a shower stall, the back wall 19 is preferably shaped with a T-shaped slot 20 on the mounting side. The T-shaped slot 20 engages slidably and removably with the mounting plate 36. The mounting plate 36 attaches fixedly to the shower wall, and this attachment may be accomplished in a number of ways including suction cups, glue, nails, and the like. In this manner the enclosure 11 may be removed from the mounting plate 36 which allows for easier access for removing and cleaning the enclosure 11. The mounting plate is preferably rectangularly shaped with a first side 37 and a second side 38. The mounting plate is made to slidably engage with the T-shaped slot by forming a projection 38 on the first side 37 and forming a projection 42 on the second side 41. The projections are typically made by starting at the first end 39 of the first side and cutting out a portion of the width of the first side along a portion of the length of the first side to create a recessed portion 40. The recessed portion 40 is cut along only a portion of the length of the first side 37 so that the enclosure 11 can slide down onto the mounting plate 36 without sliding completely off of the mounting plate.

The lid 25 is pivotally attached to the enclosure 11. The lid 25 is spring loaded so that by pressing the release button 35 the user has access to the bar of soap 48 without opening the lid manually. In order to establish the pivoting connection, the lid 25 has at least one tab 26 on its inner surface 29 which extends downward toward the base 21. The base 21 is preferably constructed with perforations 52 for draining water away from the soap bar and back to the tub or shower floor. Also, the base 21 may be equipped with ridges 51 for the bar of soap 48 to rest on to further ensure that the soap bar is not exposed to standing water. The tab 26 has a round opening 50 which has an inside diameter which allows the pin 30 to slide through the opening with minimal clearance. The pin 30 is held at its ends by the openings in the first and second side walls of the enclosure 11, and the pin 30 is threaded through the opening 50 in the tab 26 to establish the pivotal connection of the lid 25. The pin 30 also has a coil spring 31 which fits around the outside of the pin 30 and provides the opening force when the release button 35 is pressed. The coil spring 31 fits around the pin and has a front extension 32 and a back extension 33. The back extension 33 juxtaposes with the back wall 19, and the front extension 32 juxtaposes with the inner surface 29 of the lid 25.

Figure 3:
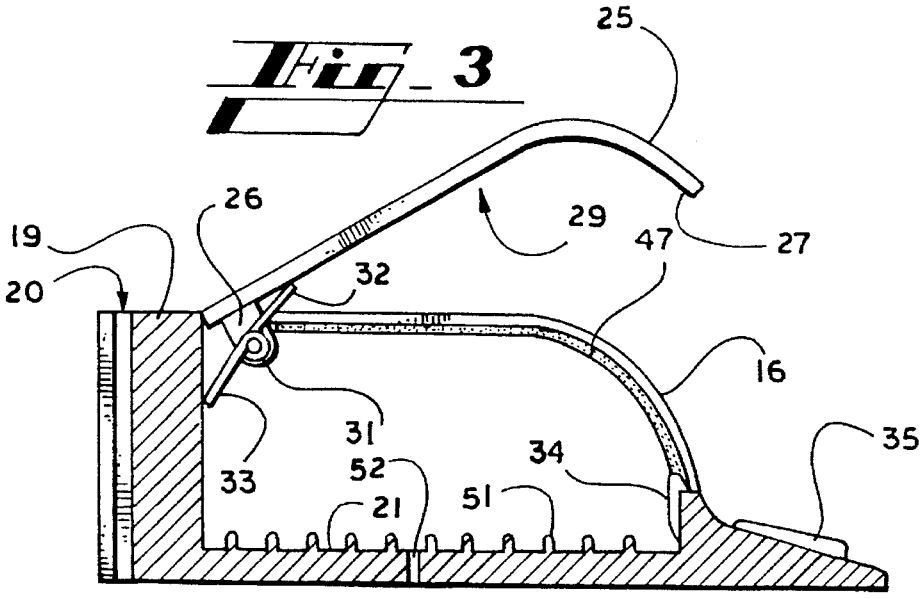
FIG. 3 is a cross-sectional side elevational view of the present invention.

As shown in FIG. 3, in order to place the lid 25 in the closed position, a hook 27 on the front of the lid is engaged with a latch 34 on the base 21. When the release button 35 is pressed the latch 34 retracts from the hook 25 and the lid 25 is rotated by the force of the coil spring 31 into its open position.

In order to seal off the opening 24 in the enclosure 11, the recessed edge 18 and the recessed edge 15 are fitted with a gasket 47. The gasket 47 is sized to fit inside the recessed edges of the side walls in order to form a water tight seal for the enclosure 11.

Other objects, advantages and capabilities of the invention will become apparent from the following description taken in conjunction with the accompanying drawings showing preferred embodiments of the invention.

What is claimed is:

1. A soap bar holder comprising:

an enclosure having a first side wall, a second side wall, a back wall, and a base, the enclosure having an opening defined by the first side wall, second side wall, and the back wall, the first side wall and second side wall having a recessed portion;

a lid, the lid being pivotally connected to the enclosure and sized to cover the opening in the enclosure, and the lid having an inner surface, and a hook, the lid being seated in the recessed portion of the first and second side walls;

a pin, the pin pivotally connecting the lid to the enclosure;

at least one coil spring, the coil spring fitting around the pin, the coil spring having a front extension and a back extension, the front extension being adjacent to the inner surface of the lid and the back extension being adjacent to the back wall of the enclosure;

a latch, the latch located at the base of the enclosure and the latch engaging with the hook on the lid; and a release button, the release button disengaging the hook on the lid from the latch on the base.

2. A soap bar holder as recited in claim 1, further comprising the base of the enclosure having a plurality of openings.

3. A soap bar holder as recited in claim 1, further comprising:

the inner surface of the lid having at least one tab extending downward towards the base, the tab having a round opening;

the first side wall having a round opening;

the second side wall having a round opening; and the pin fitting through the opening in the tab and fitting through the openings in the side walls.

4. A soap bar holder as recited in claim 3, further comprising a mounting plate having a first side, a second side, a mounting side, and an accepting side, and the back wall of the enclosure removably attaching to the mounting plate.

5. A soap bar holder as recited in claim 3, further comprising:

the opening in the first side wall having an entry portion which opens along an edge of the first side wall;

the opening in the second side wall having an entry portion which opens along an edge of the second side wall; and the pin entering the openings in the side walls through the entry portions in the edges of the side walls.

6. A soap bar holder as recited in claim 4, further comprising:

the first side of the mounting plate having a projection starting at a first end of the first side, the projection being formed by removing material along a portion of the first side to form a recessed portion, the second side of the mounting plate having a projection starting at a first end of the second side, the projection being formed by removing material along a portion of the second side to form a recessed portion; and the back wall of the enclosure having a T-shaped slot, the T-shaped slot created by removing material from the back wall, the T-shaped slot sized to slidably engage with the mounting plate, the mounting plate being removably positioned in the T-shaped slot by the projections on the first and second side of the mounting plate being seated in the T-shaped slot.

7. A soap bar holder as recited in claim 6 further comprising the lid having a perimeter edge extending around the lid, and a gasket on the perimeter edge of the lid.

8. A soap bar holder as recited in claim 7, wherein the base further comprises the base having a plurality of ridges for drainage of the water away from the soap bar.

* * * * *